US006074232A

United States Patent [19]

Choy et al.

[11] Patent Number: 6,074,232

[45] Date of Patent: Jun. 13, 2000

[54] BOARD TO BOARD ELECTRICAL CONNECTOR WITH RELEASEABLE ACTUATOR

[75] Inventors: Edmond Choy, Union City, Calif.; Jerry Wu, Chang-Hua Hsien, Taiwan

[73] Assignee: Hon Hai Precision Ind. Co., Ltd., Taipei Hsien, Taiwan

[21] Appl. No.: 09/088,434

[22] Filed: Jun. 1, 1998

[51] Int. Cl.[7] ..... H01R 13/62

[52] U.S. Cl. ..... 439/328; 439/570

[58] Field of Search ..... 439/327, 328, 439/157, 372, 570

[56] References Cited

U.S. PATENT DOCUMENTS 5,647,755 7/1997 Hida ..... 439/328

5,938,464 8/1999 Ichimura ..... 439/327

*Primary Examiner*—Lincoln Donovan

*Assistant Examiner*—Javaid Nasri

[57] ABSTRACT

A board to board electrical connector for electrically connecting a first substrate to a second substrate on which the electrical connector is mounted, comprises an insulated housing and a pair of actuators. The insulated housing further includes an elongated slot and a pair of receiving sections for receipt of the first substrate wherein each receiving section consists of a first cavity for pivotably receiving an actuator therein, a second cavity for clamping a lateral edge of the inserted first substrate therebetween to restrict the first substrate from moving along a first direction, and a partition for restricting the first substrate from moving along a second direction. The actuator includes a locking portion capable of extending through an indent defined on the partition to latch with a corresponding notch of the first substrate received within the second cavity thereby restricting the first substrate from moving along a third direction. Therefore, the inserted first substrate can be firmly retained within the connector in three-dimensional directions to avoid an electrical disengagement or a poor electrical engagement between the connector and the first substrate.

8 Claims, 5 Drawing Sheets

BOARD TO BOARD ELECTRICAL CONNECTOR WITH RELEASEABLE ACTUATOR

BACKGROUND OF THE INVENTION

1. Field of the Invention

The present invention relates to a board to board electrical connector, and more particularly to a board to board electrical connector for electrically and mechanically connecting an inserted first substrate to a second substrate on which the connector is mounted.

2. The Prior Art

A commonly used type of board to board electrical connector for use with a computer system is generally equipped with a pair of spaced towers to respectively retain two opposite lateral edges of a daughter board which is inserted into an elongated slot longitudinally defined on the connector for preventing the inserted daughter board from vacillating laterally. However, a number of conductive pads formed on the inserted daughter board are not capable of being accurately aligned with corresponding electrical contacts arranged in the slot of the electrical connector to establish a reliably electrical engagement because of the lack of multi-directional orientation means in the electrical connector. For example, due to the lack of the longitudinal orientation, an inserted daughter board with conductive pads may be move longitudinally in the slot and disengage with the corresponding electrical contacts of the connector when the daughter board is improperly inserted into the slot of the housing.

In addition, in the conventional connector, a pair of spaced and opposed vertical spring bars spaced apart from the towers are designed to retentively clamp the inserted daughter board therebetween. However, an unstable retention with regard to the inserted daughter board may result due to a high elasticity of the spring bars causing an undesired vibration.

Other type of conventional connectors further provide a releasable latching means located in the tower for cooperating with a corresponding notch defined on a lateral edge of the daughter board thereby preventing the movement of the daughter board along a direction opposite to the insertion of the daughter board to the elongated slot of the connector. However, since the retention of the latching means to the notch is generally exposed to an outside of the connector, the retention may be released by an undesired external force.

An object of the present invention is to provide a board to board electrical connector with a pair of spaced receiving sections adapted to efficiently and firmly retain an inserted daughter board within the connector in three-orthogonal directions thereby avoiding an electrical disengagement or a poor electrical engagement between the connector and the daughter board.

Another object of the present invention is to provide a board to board electrical connector with a pair of spaced receiving sections each divided by a partition into a first cavity and a second cavity wherein the first cavity is adapted to accommodate a rotatable actuator with a locking portion, and the second cavity is adapted to accommodate a corresponding notch defined on a lateral edge of the daughter board and retained therein by the locking portion thereby protecting the retention therebetween from an undesired external force.

SUMMARY OF THE INVENTION

According to an aspect of the invention, a board to board electrical connector for electrically connecting a first substrate to a second substrate on which the electrical connector is mounted, comprises an insulated housing and a pair of actuators. The insulated housing includes an elongated slot for receipt of a bottom edge of the first substrate, a plurality of contacts alternately arranged in the slot for electrical engagement with the first substrate, and a pair of spaced receiving sections respectively located on opposite ends of the slot. Each of the receiving sections consist of a first cavity defined by a pair of sidewalls and a partition for pivotably receiving an actuator therein, a second cavity defined by a pair of spaced supporting walls and the partition for clamping a lateral edge of the inserted first substrate thereby restricting the first substrate from moving along a first direction, and the partition separating the first cavity from the second cavity for abutting against the lateral edge of the inserted first substrate to restrict the first substrate from moving along a second direction orthogonal to the first direction. The pivotable actuator includes a releasing portion extending outward from an end of the main body for providing a manual release operation, a pair of lateral pivot portions respectively formed on a pair of spaced spring legs opposite the releasing portion for cooperating a pair of pits of the first cavity of the housing, a locking portion capable of extending through an indent defined on the partition to project into the second cavity and to latch with a correspond notch of the first substrate therein thereby restricting the first substrate from moving along a third direction orthogonal to the first and the second directions. Thus, the inserted first substrate can be firmly retained within the slot of the connector in three-dimensional directions thereby avoiding an electrical disengagement or a poor electrical engagement between the connector and the first substrate.

DETAILED DESCRIPTION OF THE PREFERRED EMBODIMENT

Figure 1:
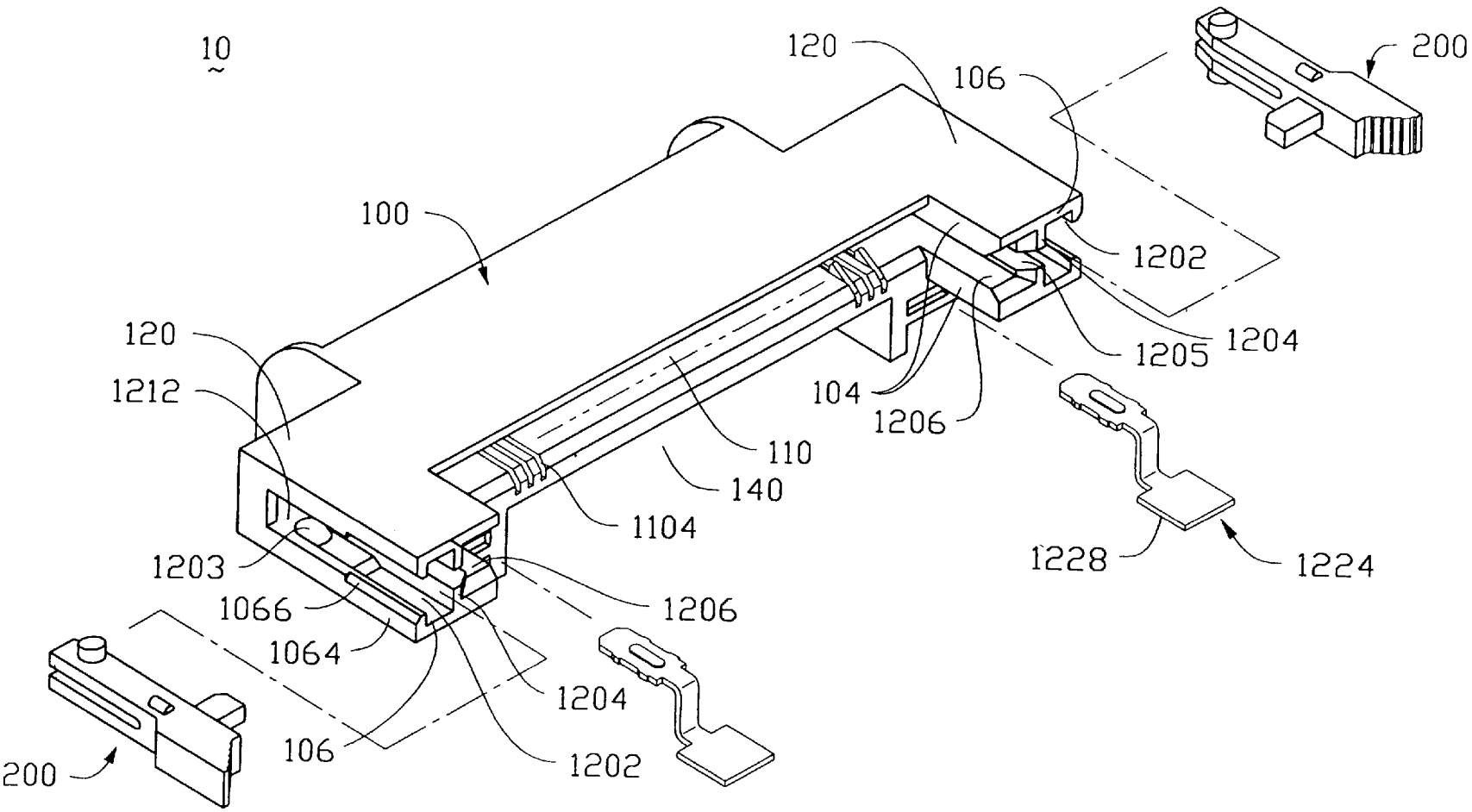
FIG. 1 is an exploded perspective top view of a board to board electrical connector according to the present invention.
Figure 2:
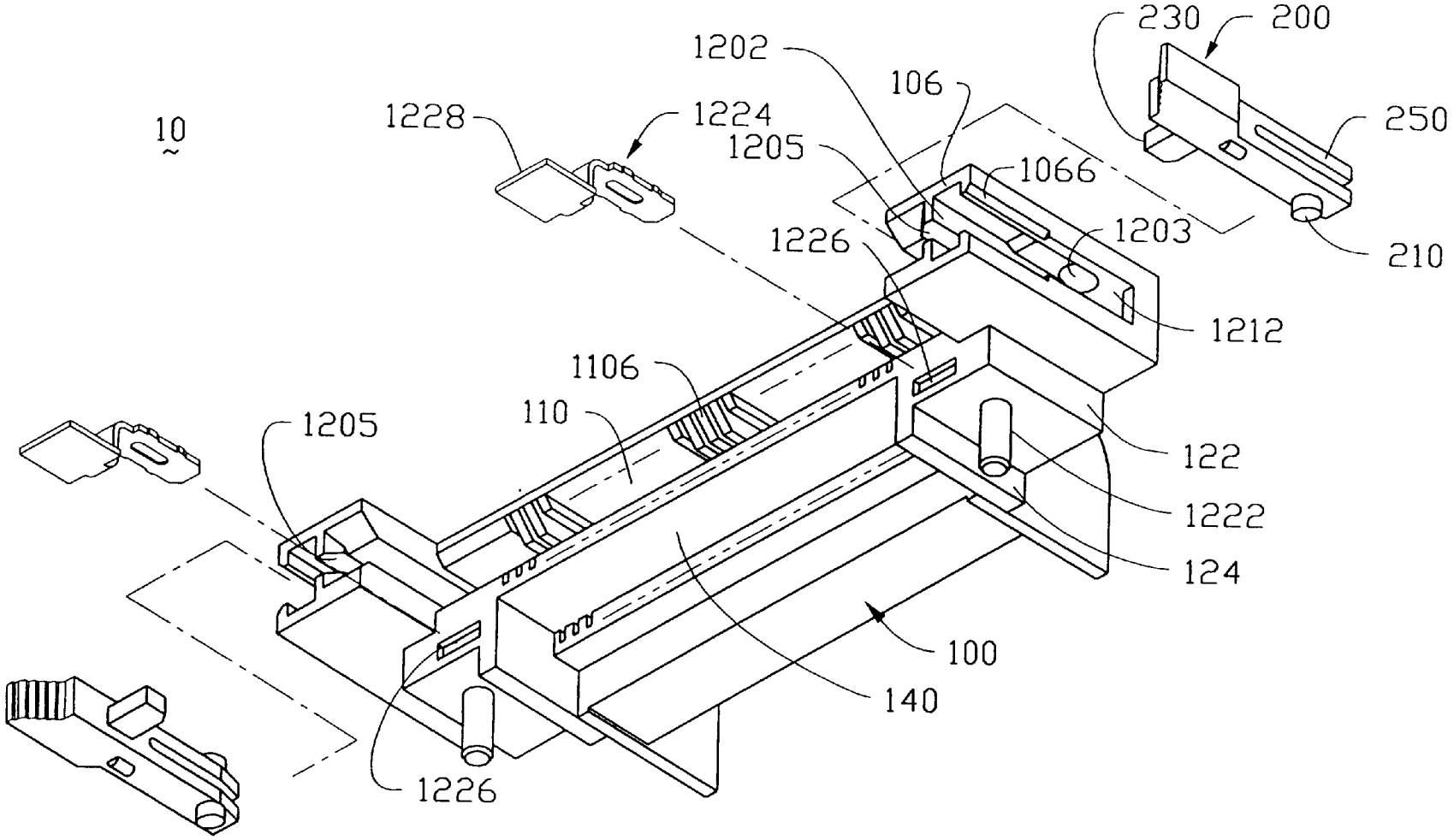
FIG. 2 is an exploded perspective bottom view of FIG. 1.
Figure 3:
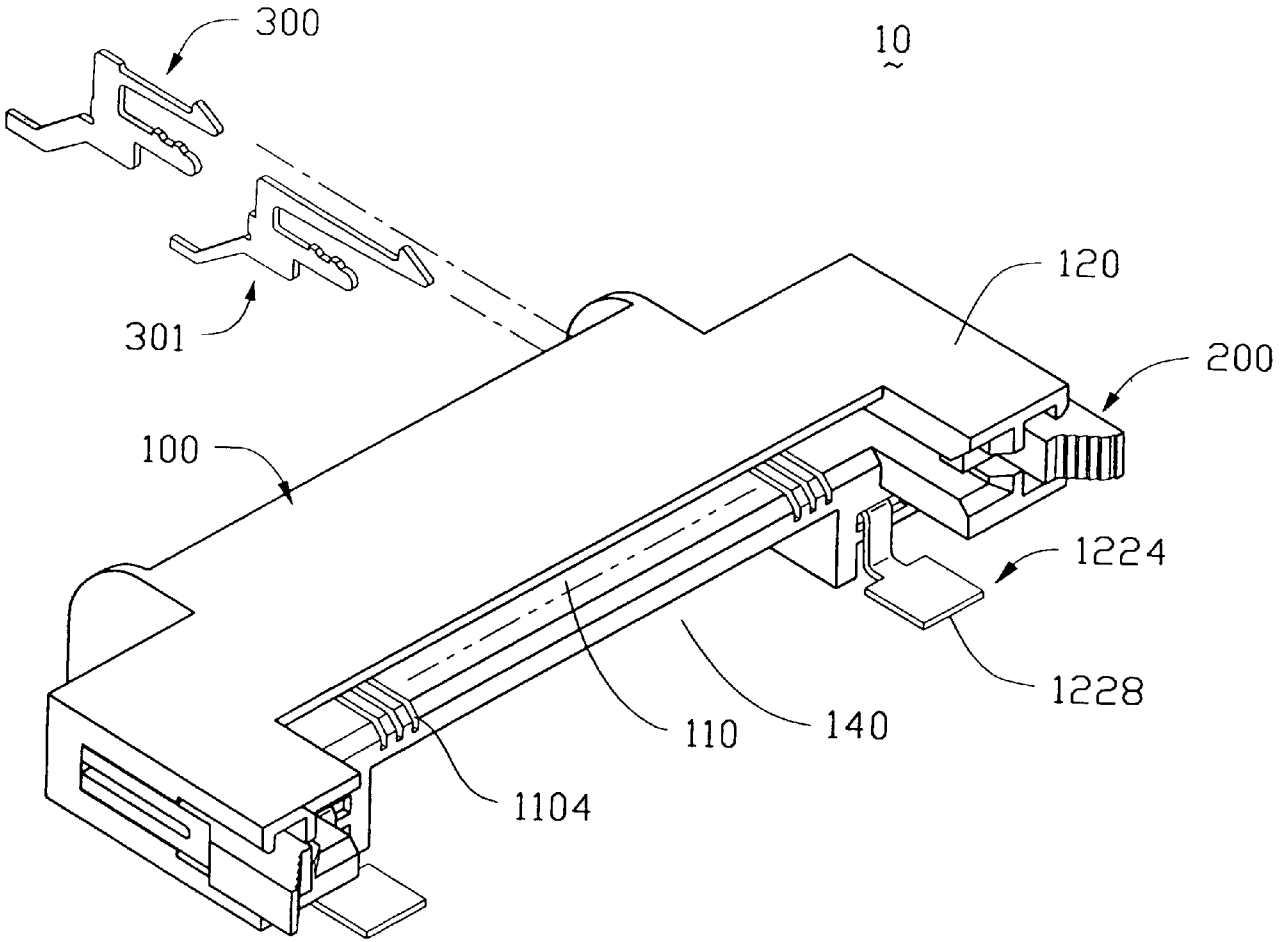
FIG. 3 is a perspective view of the assembled board to board electrical connector showing the insertion of two different contacts.

Reference will now be in detail to the preferred embodiment of the present invention. Attention is directed to FIGS. 1–3 wherein a board to board electrical connector 10 for electrically connecting a first substrate 400 (see FIG. 4A) to a second substrate (not shown) such as a mother board on which the connector 10 is mounted, includes an insulated housing 100 having an elongated slot 110 longitudinally defined thereon for receipt of a bottom edge of the first substrate and a pair of spaced and opposed receiving sections 120 respectively located adjacent to opposite ends of the slot 110 and extending outward parallel to a top surface of the second substrate. A plurality of passageways 1104 are defined on one of the inner sides (not labeled) in the slot 110 and alternately receive the contacts 300, 301 having two different shapes as shown in FIG. 3. The contacts 300, 301 received within the slot 110 are adapted to be electrically engaged with a number of conductive pads (not shown) formed on the bottom edge of the first substrate 400 which is inserted into the slot 110. The other inner side of the slot 110 forms a plurality of slanted guiding blocks 1106 for advantageously guiding the insertion of the first substrate 400.

Each receiving section 120 consists of a first cavity 1202, a second cavity 1206 and a partition 1204 located between both of cavities 1202, 1206 and separating the first cavity 1202 from the second cavity 1206. The first cavity 1202 used to accommodate an actuator 200, is defined by two opposite sidewalls 106 and the partition 1204 which is integral with the sidewalls 106, and each other wherein a pair of pits 1203 are respectively formed on the sidewalls 106. A restriction portion 1064 perpendicularly extends from each sidewall 106 inward toward the first cavity 1202 and forms a chamfer 1066 on an outer edge (not labeled) thereof. An opening 1212 is defined between the restriction portion 1064 of the sidewalls 106.

Figure 4B:
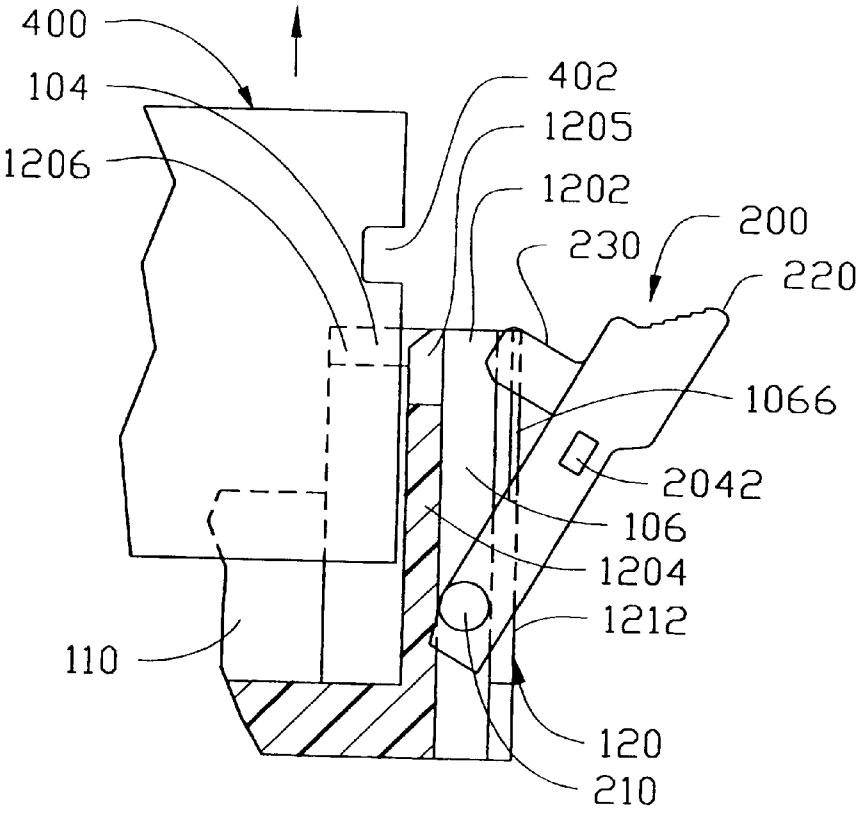
FIG. 4B is a partial cross-sectional view of the board to board electrical connector showing the daughter board is withdrawn when the actuator is pivotably located to reach an open position.
Figure 4A:
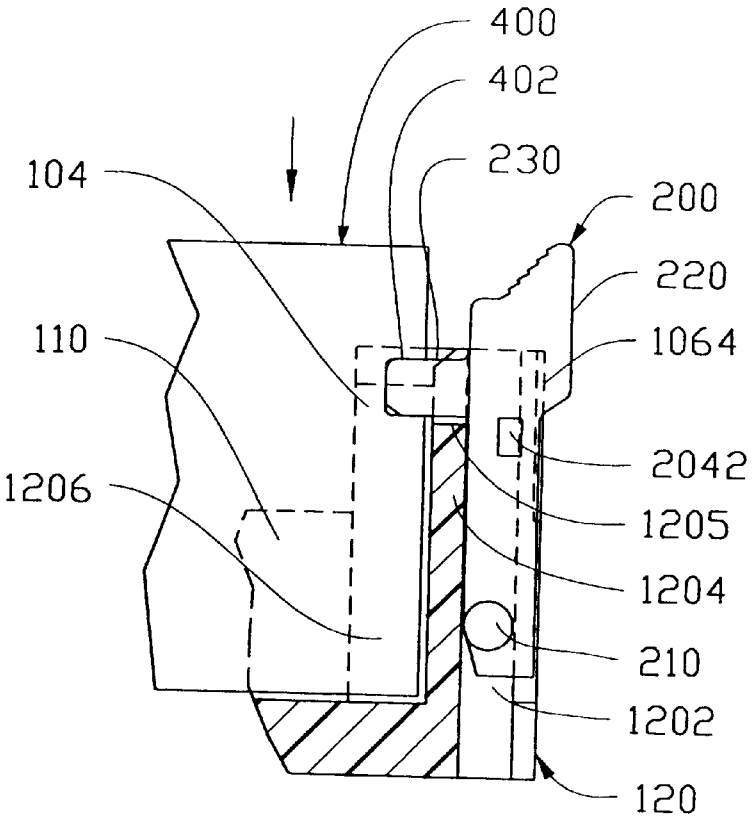
FIG. 4A is a partial cross-sectional view of the board to board electrical connector showing an inserted daughter board locked with a locking portion of an actuator of the connector when the actuator is pivotably located in a close position.

The second cavity 1206 for accommodating a corresponding lateral edge of the first substrate 400 (see FIG. 4A) is defined by two opposite supporting walls 104 and the partition 1204 in an integral connection with each other wherein the supporting walls 104 are thicker than the sidewalls 106 thereby retentively clamping the inserted first substrate 400 therebetween to restrict the lateral movement of the first substrate 400. Meanwhile, as shown in FIGS. 4A & 4B, a notch 402 formed at a lateral edge of the first substrate 400 can be received within the second cavity 1206 thereby avoiding the influence of an undesired external force. In addition, each supporting wall 104 of the second cavity 1206 is integrally formed with the corresponding sidewall 106 of the first cavity 1202 on a same side of the housing 100. The partition 1204 is adapted to abut against the lateral edge of the inserted first substrate 400 to restrict the first substrate 400 from moving along a longitudinal direction thereof, and further forms an indent 1205 on a top edge thereof to communicate between both cavities 1202, 1206.

Referring to FIG. 2, a stage 122 with a vertical post 1222 is integrally formed below each receiving section 120 for retaining the connector 10 to the second substrate, and a standoff portion 124 vertically extends from each stage 122 in a specific distance shorter than the post 1222, and is used for elevating the housing 100 to a predetermined height. A hole 1226 is defined on a front surface of each stage 122 for retentively receiving a metallic auxiliary supporting leg 1224 formed with barbs. Each auxiliary supporting leg 1224 further includes a horizontal plate 1228 which is used to abut against a top surface of the second substrate thereby enhancing a stable position of the housing 100 on the second substrate. A cave 140 is defined between the standoff portions 124 for accommodating a plurality of electrical circuits (not shown) printed on the top surface of the second substrate or an electrical element (not shown).

Figure 5B:
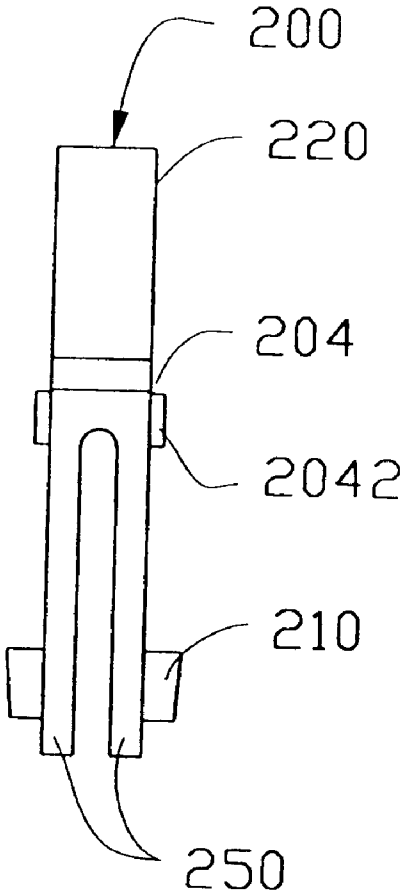
FIG. 5B is a rear view of the actuator of the board to board electrical connector.
Figure 5A:
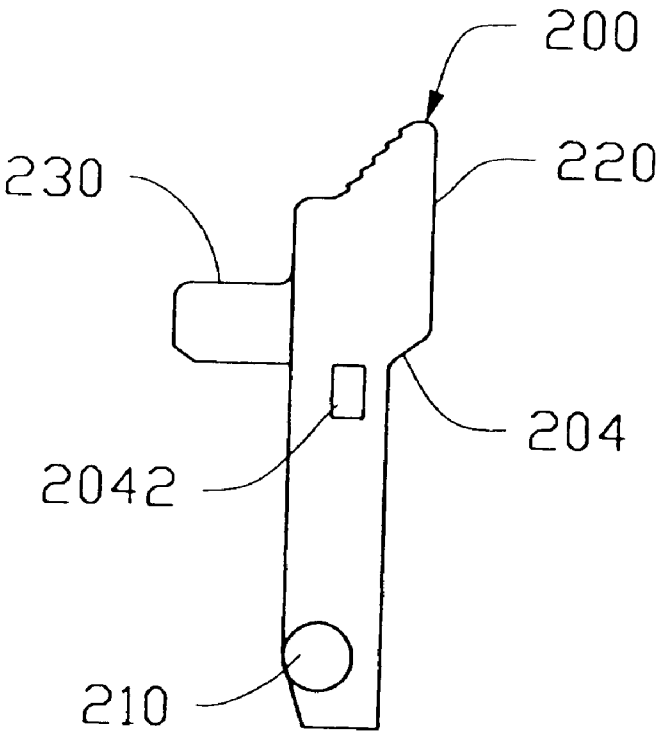
FIG. 5A is a left view of the actuator of the board to board electrical connector.

The actuator 200 as shown in FIGS. 5A & 5B includes a main body 204, a releasing portion 220 extending outward from an end of the main body 204 for providing a manual release operation, a locking portion 230 horizontally extending from the main body 204 toward the elongated slot 110 of the housing 100, a pair of spaced spring legs 250 each having a free end opposite to the releasing portion 220 and a pivot portion 210 laterally formed adjacent to each free end, and a pair of protrusions 2042 laterally formed on the main body 204.

In assembly, by means of cooperation between the pivot portions 210 of the actuator 200 and the pits 1203 of the first cavity 1202 of the housing 100, the actuator 200 is pivotably attached to the first cavity 1202. Referring to FIG. 4A, when the actuator 200 is manually rotated forward to reach a close position in the first cavity 1202, the locking portion 230 of the actuator 200 extends through the indent 1205 of the partition 1204 to project between the supporting walls 104 in the second cavity 1206 thereby accurately positioning the locking portion 230 to latch with the notch 402 of the inserted first substrate 400 which is received within the second cavity 1206. At the same time, the protrusions 2042 of the actuator 200 are stopped by the restriction portions 1064 so that the actuator 200 remains in the close position. The first substrate 400 is therefore restricted from moving along an opposite direction with regard to the insertion of the first substrate 400 into the slot 110.

Oppositely, referring to FIG. 4B, when the actuator 200 is manually rotated rearward out of the opening 1212 of the first cavity 1202 to reach an open position for releasing the retention with the first substrate 400, by means that a curved surface of each protrusion 2042 advantageously pass through the corresponding restriction portion 1064. Therefore, the first substrate 400 can be withdrawn from the slot 110 of the housing. When the actuator 200 moves from the open position to reach the close position, the chamfer 1066 of the housing 100 can advantageously guides the entrance of the protrusions 2042 of the actuator 200 to the first cavity 1202.

In conclusion, it is apparently understood that in accordance with the present invention, the inserted first substrate 400 is capable of being efficiently and firmly retained within the connector 10 in three-dimensional directions thereby avoiding an electrical disengagement or a poor electrical engagement between the connector 10 and the first substrate 400. Also, the second cavity 1206 of the housing 100 encloses the retention of the locking portion 230 of the actuator 200 with the corresponding notch 402 on the inserted first substrate 400 thereby protecting the retention from an undesired external force.

While the present invention has been described with reference to specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

Therefore, persons of ordinary skill in this field are to understand that all such equivalent structures are to be included within the scope of the following claims.

We claim:

1. An electrical connector for electrically connecting a first substrate to a second substrate on which the electrical connector is mounted, comprising:

an insulated housing having an elongated slot formed along a longitudinal axis thereof for receipt of a bottom edge of the first substrate, a plurality of contacts arranged in the slot, and a pair of receiving sections respectively extending outward from opposite ends of the slot wherein at least one of the receiving sections consists of a first cavity and a second cavity, the second cavity receiving therein a lateral edge of the first substrate inserted within the slot thereby restricting the first substrate from moving along a first direction, and a partition located between the first cavity and the second cavity, the partition being adapted to abut against the lateral edge of the inserted first substrate thereby restricting the first substrate from moving along a second direction orthogonal to the first direction, a restriction portion being formed at an outer side of the first cavity of the at least one receiving section and opposite the partition, said restriction portion defining an opening therein; and an actuator received within said first cavity, including at least a pivot portion cooperating with a corresponding pit formed in the first cavity for a rotatable movement of the actuator between a releasing position and a latching position, a releasing portion extending outward for providing a manual release operation to move the actuator to the releasing position, and a locking portion extending toward the slot of said housing, the locking portion being adapted to latch with a corresponding notch defined on the lateral edge of the inserted first substrate when the actuator is moved to the latching position thereby restricting the first substrate from moving along a third direction orthogonal to the first and the second directions, and a protrusion being formed on the actuator and adapted to enter into the first cavity and to interferentially engage with the restriction portion to retain the actuator within the first cavity at the latching position, and to be pulled out of the first cavity through the opening and past the restriction portion to the releasing portion.

2. The electrical connector as described in claim 1, wherein the first cavity is defined by a pair of side walls of the receiving sections and the partition is an integral connection with the side walls and the restriction portion also is an integral connection with the side walls and lying in a plane intercepting the pivotal movement of the actuator.

3. The electrical connector as described in claim 1, wherein the second cavity is defined by a pair of supporting walls of the receiving sections and the partition is an integral connection with each supporting wall.

4. The electrical connector as described in claim 1, wherein the second cavity further includes a pair of spaced supporting walls for clamping therebetween the lateral edge of the first substrate.

5. The electrical connector as described in claim 1, wherein the locking portion of the actuator extends through an indent defined adjacent to a top edge of the partition of the housing when the locking portion latches with the notch of the first substrate.

6. The electrical connector as described in claim 1, wherein the pivot portion is formed adjacent to a free end of the actuator and the releasing portion is formed adjacent to an opposite end of the actuator.

7. An electrical connector for electrically connecting a first substrate to a second substrate on which the electrical connector is mounted, comprising:

an insulated housing having an elongated slot formed along a longitudinal axis thereof for receipt of a bottom edge of the first substrate, a plurality of contacts arranged in the slot, and a pair of receiving sections respectively extending outward from opposite ends of the slot wherein at least one of the receiving sections includes a cavity including a pair of spaced supporting walls for clamping a lateral edge of the first substrate therebetween to restrict the first substrate from moving along a first direction, and a partition located between the supporting walls for restricting the first substrate from moving along a second direction orthogonal to the first direction; and an actuator pivotably located outside of the cavity and having a locking portion extending toward the slot of the housing for latching with a notch of the first substrate received within the cavity of the housing to restrict the first substrate from moving along a third direction orthogonal to the first direction; wherein the partition further includes an indent through which the locking portion of the actuator extends thereby accurately positioning the locking portion to latch with the notch of the first substrate.

8. The electrical connector as described in claim 7, wherein the supporting walls and the partition are integrally connected with each other.

* * * * *